United States Patent [19]

Roberts et al.

[11] 4,383,020

[45] May 10, 1983

[54] PREPARATION OF PHOTOCONDUCTIVE FILM USING RADIATION CURABLE RESIN

[75] Inventors: Sidney J. Roberts, Dennison; Deanna M. Dowdle, Northfield, both of Minn.

[73] Assignee: Sheldahl, Inc., Northfield, Minn.

[21] Appl. No.: 198,627

[22] Filed: Oct. 20, 1980

Related U.S. Application Data

[63] Continuation-in-part of Ser. No. 111,258, Jan. 11, 1980, abandoned.

[51] Int. Cl.[3] ..... G03G 5/05

[52] U.S. Cl. ..... 430/127; 430/130; 430/133; 430/134; 430/96; 430/300; 430/311; 430/319; 430/906; 427/53.1; 427/54.1

[58] Field of Search ..... 430/130, 132, 133, 134, 430/127, 300, 311, 319

[56] References Cited

U.S. PATENT DOCUMENTS

| | | | |
|---|---|---|---|
| 3,291,600 | 12/1966 | Nicoll | 430/130 X |
| 3,625,696 | 12/1971 | Krauch | 430/906 X |
| 4,092,173 | 5/1978 | Novak | 430/906 X |

*Primary Examiner*—John D. Welsh

*Attorney, Agent, or Firm*—Orrin M. Haugen; Thomas J. Nikolai

[57] ABSTRACT

An improvement in the method of preparing a coating or layer of reprographic material upon a substrate which includes the conventional steps of coating the substrate surface with a layer of resinous binder curable upon exposure to radiant energy including electron beam and ultraviolet radiation, the binder layer containing reprographic solids. The resinous binder is applied as a fluid and is irradiated until a coherent and adherent layer is formed. The method includes the steps of forceably applying and tautly maintaining a sheet of a smooth flexible film against the surface of the curable resinous binder while directing a beam of radiant energy through the sheet and onto the binder while the layer of flexible film is held thereagainst. The exposure to radiant energy is continued until the resinous binder is substantially completely cured, whereupon the sheet of flexible film is removed from the surface of the binder. The reprographic solids preferably consist of cadmium sulfide, cadmium selenide, or alloys thereof.

3 Claims, 2 Drawing Figures

PREPARATION OF PHOTOCONDUCTIVE FILM USING RADIATION CURABLE RESIN

CROSS-REFERENCE TO RELATED APPLICATION

The present application is a Continuation-in-Part of our copending application Ser. No. 111,258, filed Jan. 11, 1980, abandoned, entitled REPROGRAPHIC DRUMS.

BACKGROUND OF THE INVENTION

The present invention relates generally to a method for preparing a reprographic film upon a substrate, and more specifically to a method for preparing a reprographic film having a highly polished surface, with the highly polished surface being formed during an in-situ curing of the binder. The technique is accomplished without the need for mechanical polishing operations.

Reprographic articles and materials are in wide use in the duplicating industry, particularly in the formation of dry copies. The reprographic layer or film forms the essential feature of a wide variety of copy machines, particularly those operating in the xerographic mode. The surface quality of the reprographic film is normally reflected in copy quality, and a smooth highly polished and uniform film has been found to be necessary if not required to produce copy qualities of high quality.

In the past, various techniques have been employed to provide a smooth, durable, and highly polished surface for the reprographic layer or film. While various techniques, including polishing and the like have been undertaken, these techniques are labor-intensive, and thus highly expensive, and may, in certain instances, deleteriously affect the quality of the reprographic film. For example, in certain polishing operations, the surface of the reprographic film may be exposed to buffing operations and substantial quantities of the solid reprographic material may be exposed, and such exposure, if on a gross basis, may adversely affect copy quality. On the other hand, it is normally desirable that the surface of the reprographic film be uniform and coherent, and include for the most part a cohesive layer of resinous material having reprographic solids trapped immediately therebeneath. In addition, certain of the reprographic solids are regarded as hazardous chemicals, and their presence, particularly in the form of powders formed in polishing operations may adversely affect the conditions for the workers, as well as adversely affect the environment.

SUMMARY OF THE INVENTION

In accordance with the present invention, a technique is provided for forming a reprographic film having solid particles contained therein, and wherein the surface quality of the reprographic film is enhanced, and is smooth and highly polished without need for separate mechanical polishing operations. Specifically, this technique includes forceably applying a smooth flexible film having a surface for replication, against the surface of the uncured binder-reprographic material layer, and thereafter directing a beam of radiant energy onto the binder while the surface of the flexible film is maintained thereagainst. Exposure to radiant energy is continued until the resin is substantially cured, whereupon the flexible film is removed from the surface of the cured binder.

Although suitable for flat plates, curved plates and the like, this operation is preferably undertaken in the formation of reprographic drums. Specifically, the surface of the drum is coated with a raw resinous binder containing reprographic solids, and the solvent is removed therefrom. Thereafter, the drum is mounted so as to be controllably rotated, and a flexible film having a smooth surface is forced against the surface of the reprographic layer. The wrap is maintained along a substantial portion of the circumference of the drum, and while exposed to the wrap, a beam of radiant energy is directed onto the surface of the binder, with the energy being sufficient to achieve at least a substantial cure during a single exposure. Multiple exposures are normally desirable, since the cure is then uniformly achieved throughout the entire circumference. The substrate upon which the material is cured will normally be the permanent substrate for the reprographic material, however, in certain applications, a temporary substrate will be employed and the cured material thereafter transferred and bonded to a permanent substrate. The present invention is, of course, applicable to both processes.

The flexible film employed for contact with the exposed working drum surface is, of course, one which is suitable for replication. One such film which has been found highly desirable is stress-oriented polyethylene terephthalate, which is commercially available.

Therefore, it is a primary object of the present invention to provide an improved technique for the preparation of a reprographic layer on the surface of a substrate, and wherein the reprographic layer has a smooth, uninterrupted working surface which is highly polished and capable of formation of xerographic copies of high quality.

It is a further object of the present invention to provide an improved technique for the preparation of smooth and highly polished reprographic layers on substrate surfaces, and wherein the polished character or quality of the reprographic layer is formed during curing.

Other and further objects of the present invention will become apparent to those skilled in the art upon a study of the following specification, appended claims, and accompanying drawing.

DESCRIPTION OF THE PREFERRED EMBODIMENT

Figure 1:
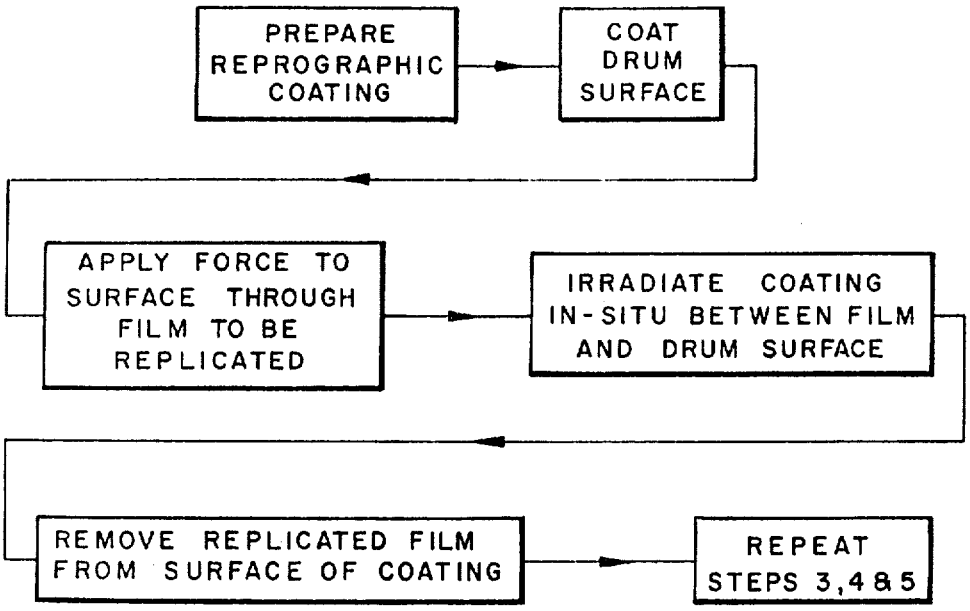
FIG. 1 is a schematic diagram illustrating the various steps undertaken in the preferred method of the present invention.

In accordance with the preferred embodiment of the present invention, and with particular attention being directed to the drawing, it will be observed that a reprographic coating formulation is initially prepared, with the formulation consisting of a resinous binder containing reprographic solids such as cadmium sulfide, cadmium selenide, or alloys thereof. (Preparation of such reprographic materials is disclosed in U.S. Pat. No. 3,037,941.) Thereafter, the prepared formulation is applied to the surface of a substrate, normally a drum, although flat substrate sheets may be employed as well. Upon removal of all solvent from the raw coating, a force is applied to the surface of the reprographic layer through a film, with the surface of the film being replicated by the raw reprographic coating formulation. While the flexible film is held against the surface, a beam of radiant energy is directed to the coating, with the energy of the beam being sufficient to effect substantial cure. The flexible film may be removed from contact with the at least partially cured coating, with a second, and possibly additional numbers of passes being made through the beam of radiant energy, with each pass being undertaken while the flexible film is held in contact with the reprographic layer being formed. In the event a reprographic material in the form of a flat planar surface or sheet is desired, then, and in those instances, the material will be formed in such a planar condition, or, alternatively, formed in the manner illustrated in the drawings and thereafter secured to a backing member along the substrate surface.

It is felt that the invention may be better understood with reference to the following specific examples:

EXAMPLE 1

The following formulation was prepared:

| Component | Quantity |
|---|---|
| Radiant energy curable acrylated urethane, available commercially as "Uvithane 893" from Thiokol Chemical Corp. of Trenton, N.J. | 1260 grams |
| N—vinyl-2-pyrrolidone | 540 grams |
| Cadmium sulfide (photoreceptive quality for reprographic use) | 1800 grams |
| Methylisobutyl ketone | 160 grams |

These components are blended together to form a uniform mix, with the acrylated urethane being, of course, curable upon exposure to radiant energy of the electron beam type. The mixture has proper viscosity for application to the surface of a drum, with a spraying operation, as is conventional, being employed. Other techniques such as dipping or application with a doctor blade may be employed. The formulation is preferably applied at a thickness of 2 mils, and is treated in an oven held at about 60° C. until the methylisobutyl ketone solvent has been removed.

Thereafter, the drum is mounted on a rotary shaft, with a web of stress-oriented polyethylene terephthalate, preferably having a thickness of one and one-half mil, (available from the E. I. DuPont deNemours Corp. of Wilmington, Del. under the Trademark MYLAR) being stretched thereover. The surface of the stress-oriented polyethylene terephthalate is one desirable for replication in the reprographic layer. The force applied between the roller (18" in length) and the drum is approximately 600 lbs., it being understood that less force may be effective, and it being further understood that greater force may cause portions of the layer to extrude excessively. The roller is heated and maintained at a temperature of about 60° C. The drum is then rotated continuously until it is entirely exposed to radiation in the form of an electron beam. Specifically, the beam has a power input of approximately 200 KV across its 18-inch length. This provides sufficient energy for the beam to penetrate the flexible wrap material and cure the radiant energy curable resin. While one such exposure may be sufficient to substantially cure the resin, it is desirable to provide a sufficient number of passes so that there is no gradient between cured and partially cured resin.

Figure 2:
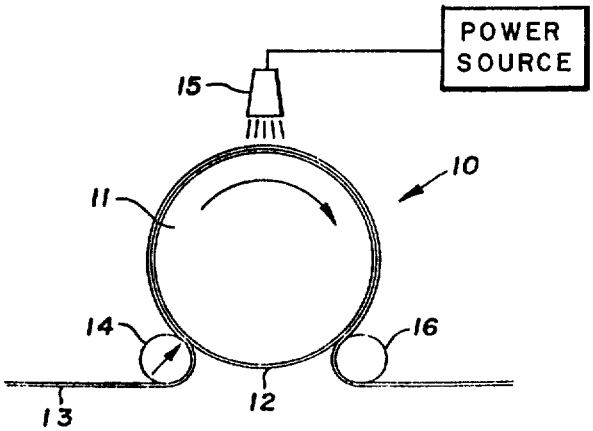
FIG. 2 is a simplified elevational view of a typical reprographic layer curing operation conducted in accordance with the method of the present invention.

The mechanism illustrated schematically in FIG. 2 of the drawing is desirable for this purpose. Specifically, the curing system generally designated 10 includes a drum 11 having a layer of reprographic material 12 disposed thereon, and with a web or wrap 13 of a flexible film having a surface to be replicated being wrapped about a substantial portion of the arcuate circumference of the drum 11. Roller 14 is biased mechanically toward the surface of drum 11, so as to tautly maintain web 13 is in contact with the drum across the full extent of the wrap. A radiant energy source is shown at 15, with a power source being shown coupled thereto, and with the beam of energy being applied directly to the surface 12 of drum 11. A secondary idler roller 16 is provided at the termination of the wrap, with a small arcuate segment being disposed between rollers 14 and 16. Upon continuous operation, the drum 11 is rotated throughout several revolutions while exposed to the radiant energy from source 15, thereby achieving substantial and full cure of the radiant energy curable resin binder. These operations are all conducted at room temperature.

EXAMPLE 2

The following formulation was prepared:

| Component | Quantity |
|---|---|
| An acrylated urethane sold under the designation "Lord Hughson Photoglaze TS-3401-1F" available commercially from Hughson Chemical Co. of Erie, PA. | 100 grams |
| Cadmium sulfide | 100 grams |

The material is blended and applied to the surface of a substrate, in the form of a drum, by dipping with the raw material having a residual thickness of 3 mils. Upon removal of the solvent, the material is cured in the fashion illustrated in Example 1, with the exception being that the material is cured through exposure to ultraviolet radiation of approximately 380 millimicrons. The ultraviolet exposure is continued until the resin is fully cured.

EXAMPLE 3

The following formulation was prepared:

| Component | Quantity |
|---|---|
| Radiant energy curable acrylated urethane, available commercially as "Uvithane 893" from Thiokol Chemical Corp. of Trenton, N.J. | 100 grams |
| Benzophenone | 2.5 grams |
| Dimethylamino ethanol | 2.5 grams |
| Methylisobutyl ketone | 20 grams |
| Cadmium sulfide | 105 grams |

The material is blended and following blending, is applied by conventional coating techniques (spraying) to the surface of a drum. The solvent components are removed and the device is placed in the system illustrated in FIG. 2, wherein the resinous component is exposed to ultraviolet radiation as set forth in Example 2. The exposure is continued until the resin has been cured.

EXAMPLE 4

The formulation of Example 1 was prepared, substituting cadmium selenide for the cadmium sulfide on a 1:1 weight basis, and with similar coating and curing techniques being employed.

EXAMPLE 5

A formulation was prepared containing the following components:

| Component | Quantity |
|---|---|
| Acrylated epoxy available under the designation "Celrad 3200" of Celanese Corp. of New York, N.Y. | 100 grams |
| Pentaerythritol triacrylate | 20 grams |
| Cadmium sulfide/cadmium selenide (50:50 by weight) | 150 grams |

This formulation was blended until uniform, and thereafter exposed to the treating technique set forth in Example 1.

EXAMPLE 6

The material of Example 3 was prepared substituting a 50:50 by weight mixture of cadmium sulfide/cadmium selenide for the cadmium sulfide reprographic solids.

GENERAL DISCUSSION

The following comments are deemed helpful in comprehending the aspects of the present invention.

Binder

The binders employed are radiantly curable, and are preferably acrylated urethane or acrylated epoxy materials. These items are widely commercially available and are used for the purpose of providing curable materials which do not require exposure to high temperatures or the like. Materials curable by exposure to electron beam or to ultraviolet radiation are contemplated, and have been found to be desirable in the present situation.

As indicated, the availability of these materials is well known and the selection of one or another of the resin binders is not believed to be significant, it being understood that any of a wide variety of such binders may be suitably employed.

Solvent

When the formulations contain solvent materials, it is desirable that all of the solvent be removed prior to cure. This avoids the formation of bubbles and other inconsistencies in the surface of the film, thereby detracting from uniformity.

Reprographic Solids

It will be appreciated that either cadmium sulfide or cadmium selenide of photoreceptive grade may be employed, along with mixtures or alloys thereof. Photoreceptive grade cadmium sulfide and/or cadmium selenide are, of course, commercially available, with one source being the Sylvania Division of General Telephone and Electronics Co. of New York, N.Y.

Curing Energy

For most electron beam curable resins, exposure to between 1 and 10 megarads is sufficient. The energy available for the beam must be sufficient to provide good penetration of the web of film being replicated, as well as the reprographic layer itself. Multiple passes can be utilized to achieve full and complete cure.

Release Coating on Film to be Replicated

The surface of the film being replicated is preferably treated with a release agent. Release agents of the silicone oil type, or copper or chromic fatty acid complexes may be employed. Copper stearate as well as chrome stearate may be employed, with both such materials being commercially available. A film of nylon may also be employed for this purpose.

It is desirable that the release agent selected be one which does not deleteriously affect the qualities of either the surface to be replicated or the reprographic layer. Those indicated above have been found to operate satisfactorily.

General Comments

The smoothness parameters for the working surface of the finished film are preferably found to be below 5 microinches. As such, a high quality xerographic layer is formed. In actual use under normal operating conditions, the reprographic material is found to be highly cohesive, and the smoothness factor is believed to contribute to a substantial reduction in the generation of cadmium sulfide containing powder in the xerographic apparatus. As previously indicated, certain reprographic solids including those of the type utilized herein are considered to be hazardous, and their presence in any working environment is undesirable. The working environment contemplated includes those areas in which xerographic apparatus are being utilized, such as in offices and other commercial establishments.

While various techniques may be utilized to apply the raw resin material to the substrate surface, it will be appreciated that either spraying or dipping are desirable techniques, while web-coating including the use of doctor blades, wire-wound rods, reverse roll coating, or gravure-type coating may be utilized. In one type of coating technique, a flexible web may be utilized as a temporary substrate, with the material from the flexible web being transferred to the ultimate substrate. In one such technique, the web may be coated with a relatively thin segment of material, which is thereafter spirally wound onto the surface of the ultimate substrate, such as a reprographic drum. Also, a flexible web may be utilized as a permanent substrate, with the flexible web being wound onto the surface of a pre-formed drum. The system is desirable in that replacement reprographic layers may be provided in flat form, it being unnecessary to ship the ultimate drum to a coating facility for reprographic layer replacement.

The finished film preferably has a thickness of between 1.5 and 3 mils, with a film thickness of approximately 1.5 mils being generally preferred.

Post-cure treatment is generally not required, it having been found that the radiant energy cure is sufficient as set forth herein.

We claim:

1. In the method of preparing a reprographic film upon a substrate including the steps of coating the substrate surface with a layer of a resinous binder curable upon exposure to radiant energy including electron beam and ultraviolet radiation, the binder containing a fill of reprographic solids, and thereafter curing the resinous binder until a coherent and adherent layer is formed; said method including the steps of:

(a) forceably applying and tautly maintaining a layer of a smooth flexible film against the surface of said curable resinous binder;

(b) directing a beam of radiant energy onto said resinous binder while said layer of flexible film is held thereagainst;

(c) continuing the exposure of said resinous binder to radiant energy until cure is substantially completed; and (d) removing said layer of flexible film from the surface of said resinous binder.

2. The method as defined in claim 1 being particularly characterized in that said flexible film is stress-oriented polyethylene terephthalate.

3. A reprographic film prepared in accordance with the method of claim 1.

* * * * *